US006135195A

United States Patent [19]

Lee et al.

[11] Patent Number: 6,135,195

[45] Date of Patent: Oct. 24, 2000

[54] THIXOFORMABLE SIC/2XXX AL COMPOSITES

[75] Inventors: Jae Chul Lee; Ho In Lee; Ji Young Byun, all of Seoul, Rep. of Korea

[73] Assignee: Korea Institute of Science and Technology, Seoul, Rep. of Korea

[21] Appl. No.: 09/122,317

[22] Filed: Jul. 24, 1998

[30] Foreign Application Priority Data

Feb. 4, 1998 [KR] Rep. of Korea ..... 98/3062

[51] Int. Cl.[7] ..... B22D 27/15; C22F 1/04; C22F 21/02

[52] U.S. Cl. ..... 164/46; 148/437; 148/688; 420/532; 420/548; 164/461

[58] Field of Search ..... 148/437, 688; 420/548, 532; 164/46, 461

[56] References Cited

U.S. PATENT DOCUMENTS

| | | | |
|---|---|---|---|
| 4,662,429 | 5/1987 | Wada et al. | 164/461 |
| 4,674,554 | 6/1987 | Feest | 164/46 |
| 4,713,111 | 12/1987 | Cameron et al. | 75/68 R |
| 4,928,745 | 5/1990 | Feest et al. | 164/46 |
| 5,022,455 | 6/1991 | Takeda et al. | 164/46 |
| 5,571,346 | 11/1996 | Bergsma | 148/550 |
| 5,701,942 | 12/1997 | Adachi et al. | 164/71.1 |
| 5,730,198 | 3/1998 | Sircar | 164/4.1 |
| 5,846,350 | 12/1998 | Bergsma | 148/549 |
| 5,879,478 | 3/1999 | Loue et al. | 148/438 |
| 5,911,843 | 6/1999 | Bergsma | 148/550 |
| 5,968,292 | 10/1999 | Bergsma | 148/437 |

FOREIGN PATENT DOCUMENTS 305050 3/1988 European Pat. Off. .

OTHER PUBLICATIONS

A.S. Isaikin, et al., "Compatibility of Carbon Filaments With a Carbide Coating and an Aluminum Matrix," Met. Sci. Heat Treatment, vol. 22, pp. 815–817 (1980).

The Merck Index: (10th edition, Merck 7 Co., Inc. p. 50 (1983).

T. Iseki, et al., "Interfacial Reactions Between SiC and Aluminum During Joining," Journal of Materials Science, vol. 19, pp. 1692–1698 (1984).

D.J. Lloyd, et al., "Microstructural Aspects of Aluminum–Silicon Carbide Particulate Composites Produced by a Casting Method," vol. A107, pp. 73–80 (1989).

J.C. Viala, et al., "Stable and Metastable Phase Equilibria in the Chemical Interaction Between Aluminum and Silicon Carbide," Journal of Materials Science, vol. 25, pp. 1842–1850 (1990).

H. Ribes, "Microscopic Examination of the Interface Region in 6061–Al/SiC Composites Reinforced With As–Received and Oxidized SiC Particles," Metallurgical Transactions A, vol. 21A, pp. 2489–2496 (1990).

"CRC Handbook of Chemistry and Physics": (74th edition, CRC press, p. 4–36 (1992).

J. Narciso, et al., "Reactivity of Thermally Oxidized and Unoxidized SiC Particulates With Aluminum–Silicon Alloys," Materials Science and Engineering, vol. B15, pp. 148–155 (1992).

G. Gonzalez, et al., "Interfacial Reactions in Al–Mg Metal Matrix Composites Reinforced With (Sn/Sb) Oxide Coated SiC Particles," Scripta Metallurgica et Materialia, vol. 33, No. 12, pp. 1969–1975 (1995).

(List continued on next page.)

*Primary Examiner*—Daniel J. Jenkins
*Assistant Examiner*—Nicole Coy
*Attorney, Agent, or Firm*—Scully, Scott, Murphy & Presser

[57] ABSTRACT

The present invention provides a thixoformable Al alloy composites wherein Si is added to ASTM 2000 series aluminum alloy so that the total Si content thereof may be 1–5 at. % and also a manufacturing method of thixoformable Al alloy composites comprising: obtaining a matrix of the composite containing 1–5 at. % of the total Si content by adding Si to ASTM 2000 series aluminum alloy; holding the matrix in the temperature range of 560–610° C. to obtain a liquid fraction of 40–70% and thereafter performing a thixoforming process.

2 Claims, 7 Drawing Sheets

OTHER PUBLICATIONS

A.C. Ferro, et al., "Wetting Behaviour in the Al–Si/SiC System: Interface Reactions and Solubility Effects," Acta Metall. Mater., vol. 43, No. 8, pp. 3061–3073 (1995).

W.M. Zhong, et al., "Interfacial Reactions in Al–Mg (5083)/SiCp Composites During Fabrication and Remelting," Metallurgical and Materials Transactions A, vol. 26A, pp. 2637–2649 (1995).

J.C. Lee, "Effects of Various Processing Methods on the Interfacial Reactions in SiCp/2024 Al Composites," Acta Mater., vol. 12, pp. 5303–5315 (1997).

Kim, Nack J.; Park, W. J.; Ahn, S.; Elias, L., 1994, High perfrom. Met. Ceram. Matrix Compso., Proc. Symp., p. 137–44.

McLelland, A.R.A.; Atkinson, H.V.; Anderson, P.R.G., 1999, Material Science Technology, 15(8), p. 939–945.

Gupta, M.; Lane, C.; Lavernia, E.J., 1992 26(5), Scr. Metall. Mater., p. 825–30.

Warner, T.J.; Withers, P.J.; White, J.; Jordan, R.M.; Stobbs, W.M., 1988, nterfaces Polym., Ceram., Met. Matrix Compos., Proc. Int. Conf. Compos. Interfaces, p. 537–51.

THIXOFORMABLE SIC/2XXX AL COMPOSITES

BACKGROUND OF THE INVENTION

1. Field of the Invention

The present invention relates to SiC/2xxx Al composites, in particular to Al alloy composites in which ASTM 2000 series aluminum alloy are reinforced with SiC.

2. Description of the Background Art

Interfacial characteristics in metal matrix composites (MMCs) play an important role in determining the resultant composite properties. This is because superior material properties in MMCs are attributed to the load transfer from the matrix to the reinforcement through the interface. In general, interfaces in most MMCs consists of brittle intermetallic compounds, which sometimes can degrade the resultant composite properties. As a result, optimization of the interfacial characteristics in MMCs is meaningful not only to improve the material properties but also to control adequate process parameters required to obtain a desired interfacial strength.

In Al alloy composites reinforced with SiC particles ($SiC_p$/Al alloy composites), a direct reaction between SiC and Al occurs to form hexagonal platelet-shaped $Al_4C_3$ crystals and free Si. The interest in $Al_4C_3$ and Si formed as a result of the interfacial reaction is stemmed from the fact that i) composites can be susceptible to some environments, such water, methanol, HCl, etc., due to the hydrophilic nature of $Al_4C_3$[1-4], ii) degradation of SiC itself occurs due to the formation of $Al_4C_3$, which may cause decrease in strength and modulus, and iii) free Si, formed as a result of the interfacial reaction, produces Al—Si eutectic during fabrication or heat treatment stage [5], resulting in unintended mechanical properties of the matrix alloy. Therefore, fabrication of $SiC_p$/Al alloy composites devoid of $Al_4C_3$ has been one of the major concerns.

Among various methods which have been proven to be effective in achieving such a goal, there are two widely accepted methods are: i)addition of Si into the Al matrix [6-9], and ii) artificial oxidation of SiC to produce $SiO_2$ layer on the surface of SiC [9-10]. A basic principle behind both methods is to enhance the Si activity, thereby reduce the Al activity, by dissolving a certain amount of Si within the Al matrix. Examples of the former method in the commercial application can be found from various melt-stir cast $SiC_p$/Al composites produced by Duralcan which normally contain 9.5–10.5% of Si within the matrix. Detailed chemical composition and process temperatures of various Duralcan composites are shown in Table 1. However, when fabricating $SiC_p$/wrought Al alloy composites, the use of the melt process may not be desirable due to the formation of interfacial reaction products. This is because most wrought Al alloys, such as 2xxx, 5xxx, 6xxx, 7xxx series Al alloys etc., normally contain less than 1% of Si so that the interfacial reaction cannot be avoided at temperatures where the matrix alloys exist as a liquid phase [5]. An example can be seen from the melt-stir cast $SiC_p$-6061 Al composite made by Duralcan, as shown in FIG. 1.

TABLE 1

Chemical composition of various Duralcan composites

| Product* | Si | Fe | Cu | Mn | Mg | Ni | Ti | Zn | Al | Temp (° C.) | Remark** |
|---|---|---|---|---|---|---|---|---|---|---|---|
| F3D.xxS | 9.5–10.5 | 0.8–1.2 | 3.0–3.5 | 0.5–0.8 | 0.3–0.5 | 1.0–1.5 | 0.2 max | 0.3 max | Rem | 675–732 | A380 |
| F3K.xxS | 9.5–10.5 | 0.2 max | 2.8–3.2 | — | 0.8–1.2 | 1.0–1.5 | 0.2 max | — | Rem | 675–732 | A339 |
| F3N.xxS | 9.5–10.5 | 0.8–1.2 | 0.2 max | 0.5–0.8 | 0.5–0.7 | — | 0.2 max | 0.3 max | Rem | 675–732 | A360 |
| F3S.xxS | 8.5–9.5 | 0.2 max | 0.2 max | — | 0.45–0.65 | — | 0.2 max | — | Rem | 675–732 | A359 |

*Duralcan F3D.xxS composites are general purpose die-casting composites, where F indicates Foundry, 3D corresponds to the matrix alloy, i.e., A380 Al Alloy in this case, and xxS denotes xx vol. % of SiC particle.
**Commercial alloy systems similar to those of Duralcan composites.

Of interest here is that how much Si is required to prevent the interfacial reaction at various process temperatures. In recent years, various research works in an attempt to provide the answer for this question have been carried out both using experimental methods [5-8] and theoretical calculations [1, 5, 6, 11, 12]. The theoretical results, however, vary significantly depending on authors as shown in FIG. 2. This is because most researchers except Lloyd [1] and Lee [5] only considered the variation in the Si activity within the matrix, while the variations in activities of Al were not taken into account for the calculations. In addition, most studies carried out so far have considered the reaction between SiC and the molten Al only, not between SiC and Al in its solid or semi-solid state. Another drawback found in the previous studies was that the matrix of the composite was either the pure Al or the Al—Si binary alloy, not commercial alloys. Although the $SiC_p$/Al composite system can be suitable for analyzing the relatively simple interfacial phenomena, results obtained from this system may have limitations in investigating detailed phenomena which could take place in commercial $SiC_p$ wrought Al composites.

SUMMARY OF THE INVENTION

The scope of this invention includes both the matrix alloy composition in terms of Si contents and process temperature range to shape the sprayformed SiC/2xxx Al composites using semi-solid forming(or thixoforming) process. The proposed scope was determined based on theoretical and experimental results carried out on the spray formed $SiC_p$/2014 Al composite, which represents $SiC_p$/2xxx series Al alloy composites.

Accordingly, the present invention provides thixoformable Al alloy composites wherein Si is added to ASTM 2000 series aluminum alloy so that the total Si content thereof may be 1–5 at. %, and also a manufacturing method of thixoformable Al alloy composites comprising: obtaining a matrix of the composite containing 1–5 at. % of the total Si content by adding Si to ASTM 2000 series aluminum alloy; holding the matrix in the temperature range of 560–610° C. to obtain a liquid fraction of 40–70% and thereafter performing a thixoforming process.

DETAILED DESCRIPTION OF THE INVENTION

First, the present inventors predicted equilibrium Si contents required to prevent the interfacial reaction in $SiC_p$/2xxx Al alloy composites using thermodynamic calculations. Commercial 2014 Al alloy representing 2xxx series Al alloys was used for the theoretical calculations and experimental verifications. Detailed chemical composition of the 2014 Al alloy are shown in Table 2.

TABLE 2

| | Chemical composition of 2014 Al alloy | | | | | | | |
|---|---|---|---|---|---|---|---|---|
| Al alloy | Si | Cu | Fe | Mn | Mg | Cr | Zn | Al |
| 2014 Al | 0.5–1.2 | 3.8–4.9 | 0.5 max | 0.3–0.9 | 0.4–0.8 | 0.1 max | 0.1 max | Rem |

Equilibrium Si contents in the $SiC_p$/2xxx Al composite, implying the minimum Si content required to prohibit the interfacial reaction between Al and SiC, was calculated as a function of temperature. The interfacial reaction between the 2xxx Al alloy and SiC is expressed by Eq.(1).

$$4Al_{2xxxAl}+3SiC=3Si_{in\ 2xxxAl}+Al_4C_3 \quad (1)$$

Calculations of equilibrium Si contents based on Eq. (1) require the activity values in the 2xxx Al alloy. However, due to the lack of information for the activity values in this multi-component alloy system, calculations of the equilibrium Si content based on Eq. (1) are not possible. Therefore, the 2xxx Al alloy was simplified as the Al—Si-4.5 wt. % Cu ternary alloy, assuming that minor alloying elements, such as Mg, Fe, Mn, etc., within the 2014 Al alloy would not have a significant effect on the activities of Al and Si. In this study, equilibrium Si contents were calculated using the activity values of Al and Si in the Al—Si-4.5 wt. % Cu ternary system. Under such a condition, Eq.(1) can be rewritten as Eq.(2), which is used as a basis for calculating the equilibrium Si contents in the $SiC_p$/2xxx Al composite.

$$4Al_{in\ Al—Si\text{-}4.5Cu}+3SiC=3Si_{in\ Al—Si\text{-}4.5Cu}+Al_4C_3 \quad (2)$$

The Gibbs free energy change (ΔG)associated with the interfacial reaction given by Eq.(2) can expressed as Eq.(3). Although methods for calculating equilibrium Si contents differ slightly depending whether the reaction occurs in the liquid or solid states, the equilibrium Si content can be calculated using Eq.(3) under the condition of ΔG=0.

$$\Delta G=RT\cdot\ln(a_{Si}^3/a_{Al}^4)+\Delta G_{Al4C3}-3\Delta G_{SiC}+3\Delta G_{Si} \quad (3)$$

Figure 3:
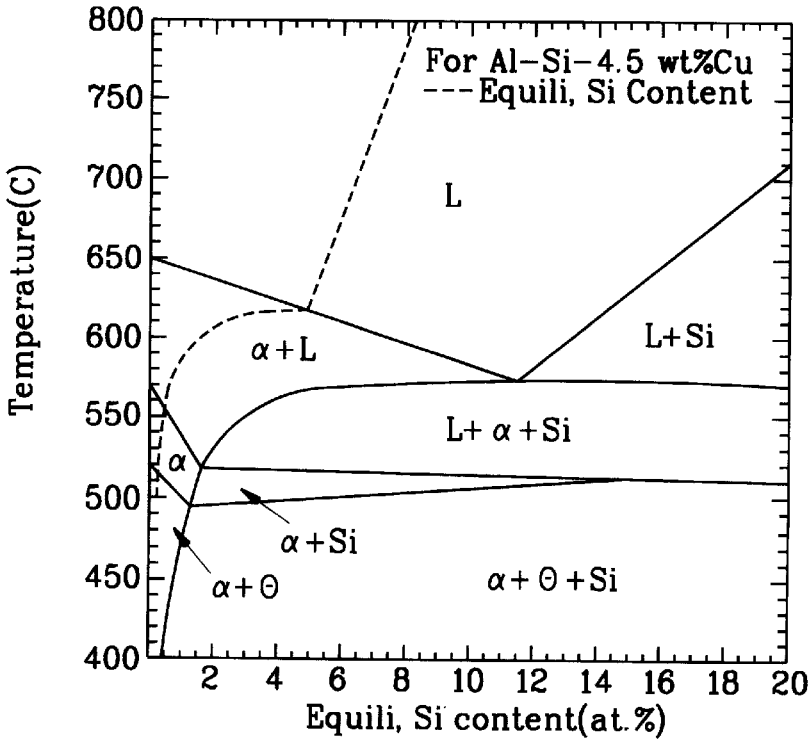
FIG. 3 shows a calculated equilibrium Si content profile plotted on the phase diagram of the Al—Si-4.5 wt. % Cu alloy. Notice a sudden increase in the Si content near 600° C.

Shown in FIG. 3 is the theoretical equilibrium Si contents in the $SiC_p$/Al—Si-4.5 wt. % Cu alloy composite, which is superposed with the phase diagram of the Al—Si-4.5 wt. % Cu alloy representing the 2xxx Al alloy. The region above the equilibrium Si content profile is where interfacial reaction favors and the region below the profile corresponds to that where the interfacial reaction is not expected.

As can be seen in FIG. 3, equilibrium Si contents increase with increasing temperature; In the case of the solid state reaction, i.e., when the matrix exists as a solid, less than 1 at. % of Si was calculated to be enough for prohibiting the interfacial reaction. However, a sudden increase in Si contents was observed at temperatures near 600° C. such that more than 5 at. % of Si is required to suppress the interfacial reaction even at 620° C.

Next, the present inventors confirmed experimentally the theoretical equilibrium Si contents required to prevent the interfacial reaction.

When heating the composite at elevated temperatures, Si contents within the composites increase due to the ejection of Si caused by the interfacial reaction, resulting in a decrease in the liquidus(melting) temperature of the composite. Therefore, DSC(differential scanning calrorimetry) was employed to predict Si content by measuring the melting temperature of the composite.

Figure 4:
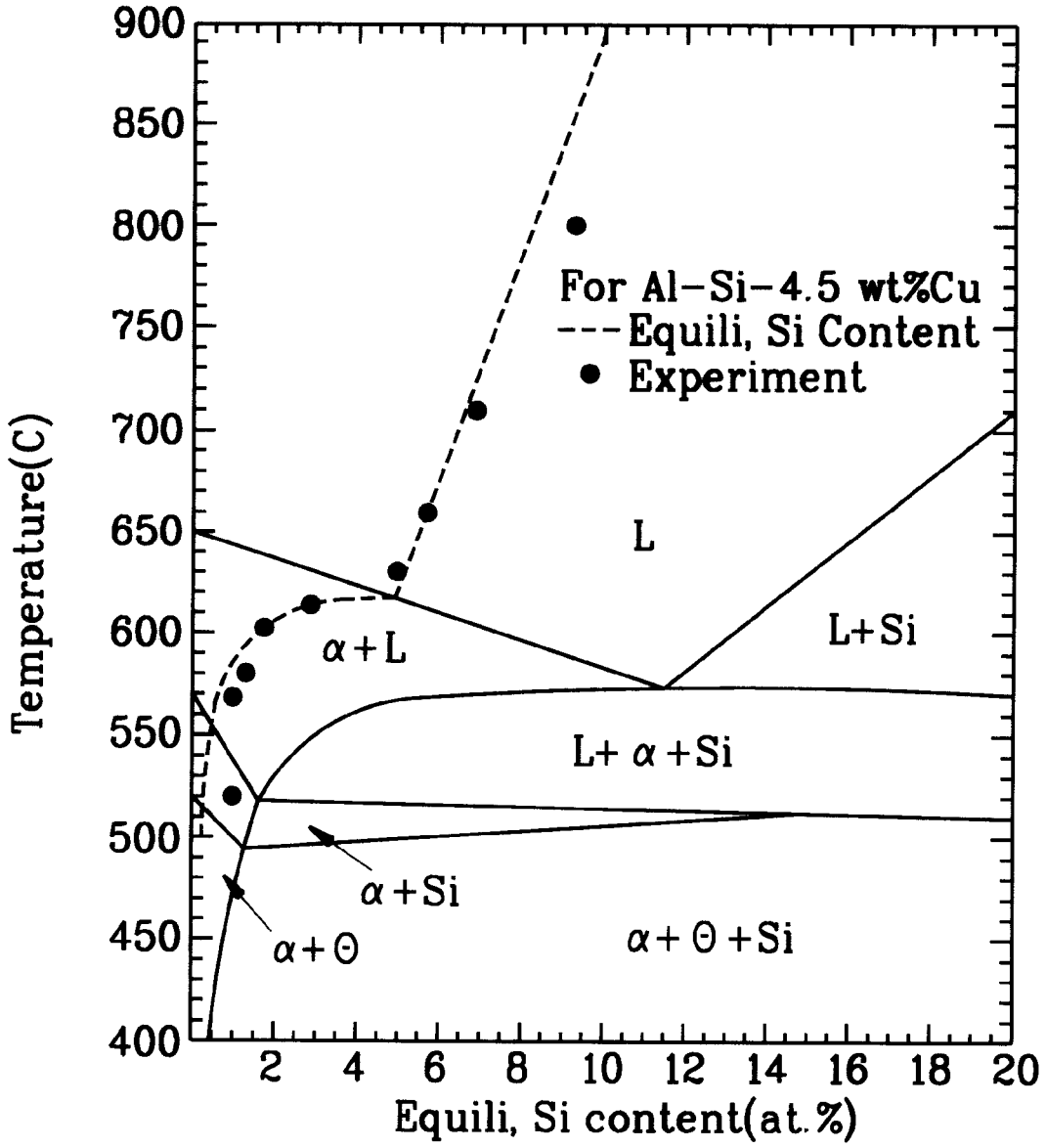
FIG. 4 shows an equilibrium Si content profiles both determined by theory and experiment. (*a*) $SiC_p$/2014 Al composite, (*b*) $SiC_p$/Al—Si composite. Activities of Al and Si used for calculations are those suggested by STGE database.
Figure 5A:
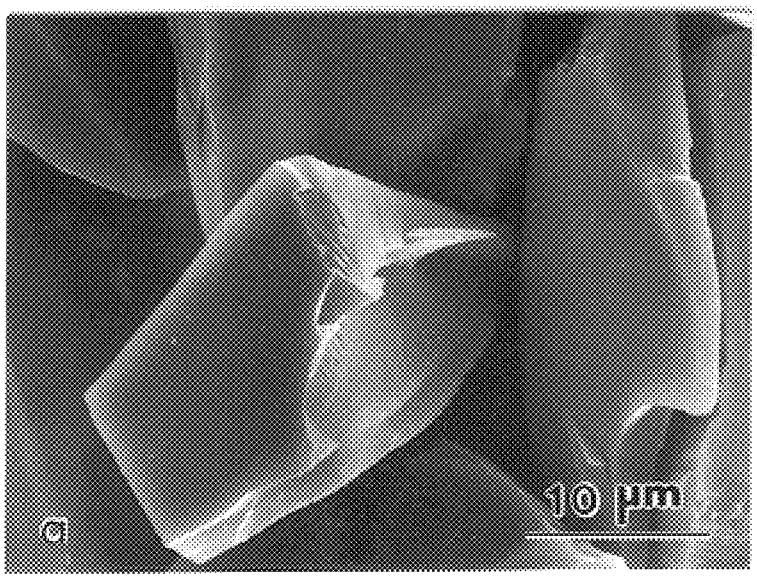
FIG. 5 shows a SEM micrographs showing the surface morphologies of (*a*) as-received $SiC_p$ and those extracted from (*b*) the spray formed, (*c*) PM hot pressed (600° C. for 10 minutes), and (*d*) compocast (continuously cooled from 700° C. to 640° C. during 1 hour period) composites. Significant degradation of $SiC_p$ is observable from the compocast composite as marked by the arrow.
Figure 5B:
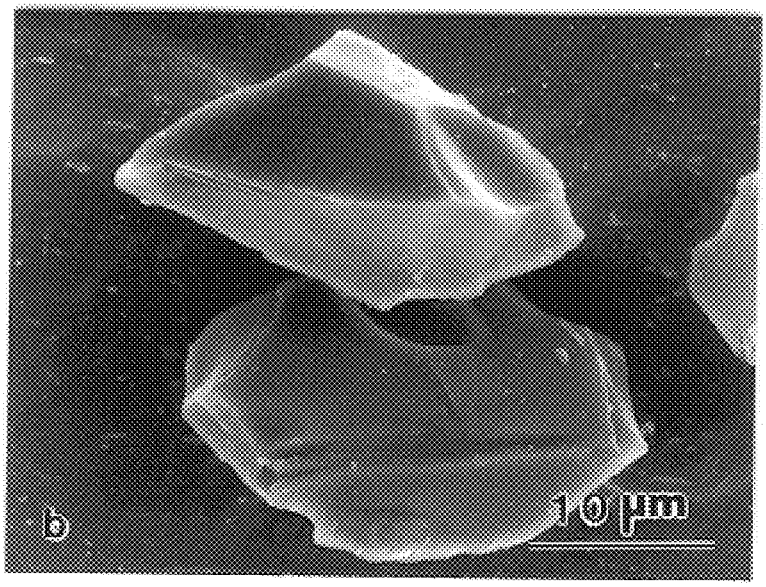
Figure 5C:
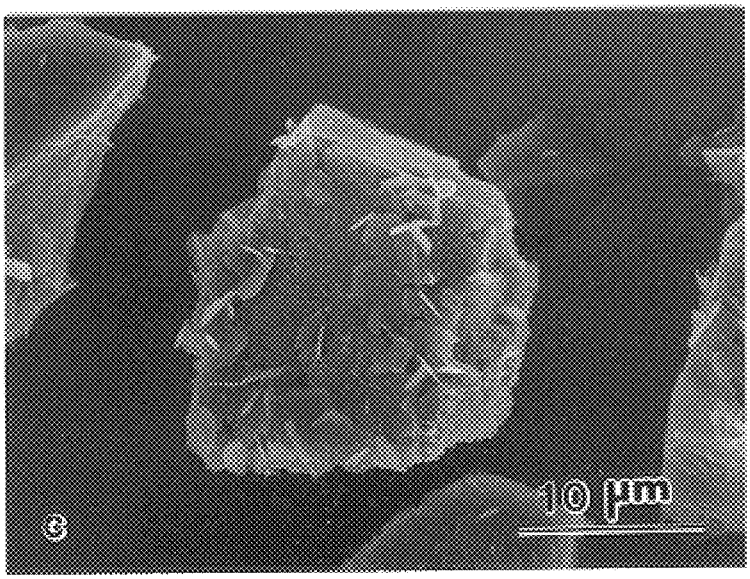
Figure 5D:
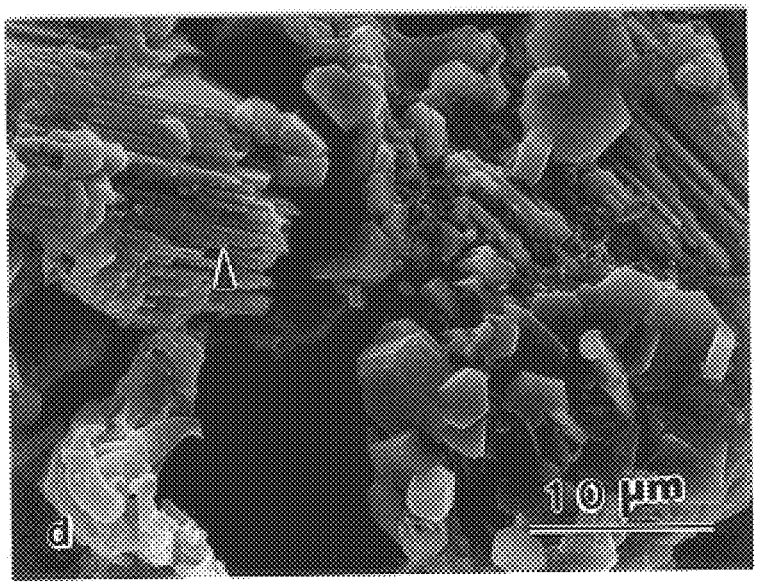

Data points plotted in FIG. 4 are the experimentally measured equilibrium Si contents in the $SiC_p$/2014 Al composite, showing a good agreement between the theoretical and experimental results. It is also noticed from this graph that a sudden increase in equilibrium Si contents has taken place near 600° C.

Figure 1A:
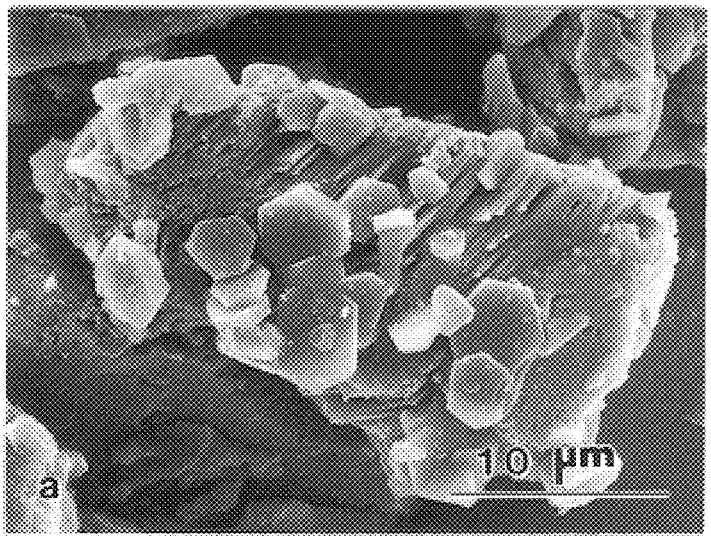
FIG. 1(*a*) shows a SEM micrograph of the SiC particle, which was extracted from the Duralcan $Sic_p$/6061 Al composite made by the melt-stir cast, showing the presence of $Al_4C_3$ and Si at its surface. Notice that degraded surface of SiC as marked by the arrow and FIG. 1(*b*) shows a magnified view of the SiC surface covered with $Al_4C_3$ and Si. Very small particles indicated by the arrow are Si crystals.
Figure 1B:
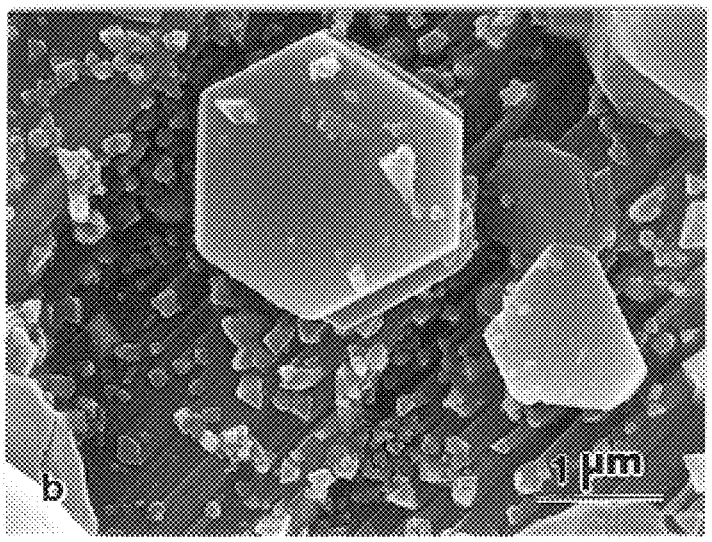
Figure 2:
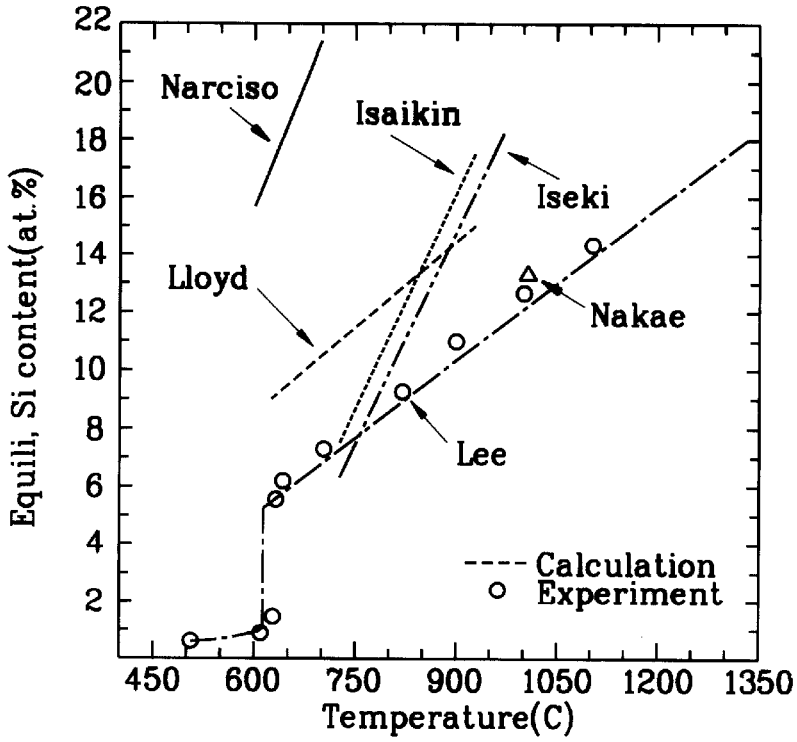
FIG. 2 shows variations in equilibrium Si contents in the $SiC_p$/Al composite determined as a function of temperature.

The significance of the presence of the transition temperature near 600° C. is that the interfacial reaction is inevitable when fabricating the $SiC_p$/wrought Al alloy composite via the melt process. Such evidence can be observed from the melt-stir cast $SiCp_p$/6061 Al composite in FIG. 1. This is why the melt process is usually applied to a certain composite systems, such as the Duralcan® F3D.20S (9.5–10.5% Si), where a prolonged contact at elevated temperatures will not degrade SiC.

In order to observe both the formation of the interfacial reaction products and the morphological evolution of SiC due to the interfacial reaction, the Al matrix was removed electro-chemically from the composites to expose interfacial reaction products as well as SiC particles. FIG. 5(*b*) is the morphologies of $SiC_p$ extracted from the sprayformed composite, showing sharp edges and smooth surface morphologies similar to those observed from the as-received $SiC_p$ as in FIG. 5(*a*). Such an observation is a good indication that no or insignificant interfacial reaction has taken place during the composite fabrication via spray-forming.

Series of micrographs showing surface morphology of SiC extracted from other composites held at various temperatures are shown in FIGS. 5(*c*) and (*d*). FIG. 5(*c*) is the surface morphology of $SiC_p$ extracted from the composite fabricated via powder metallurgical route, showing that formation of interfacial reaction products is evident. FIG. 5(*d*) is the surface morphology of $SiC_p$ extracted from the compocast composite, showing significant amount of $Al_4C_3$ and eutectic Si formed in the vicinity of SiC.

Figure 6:
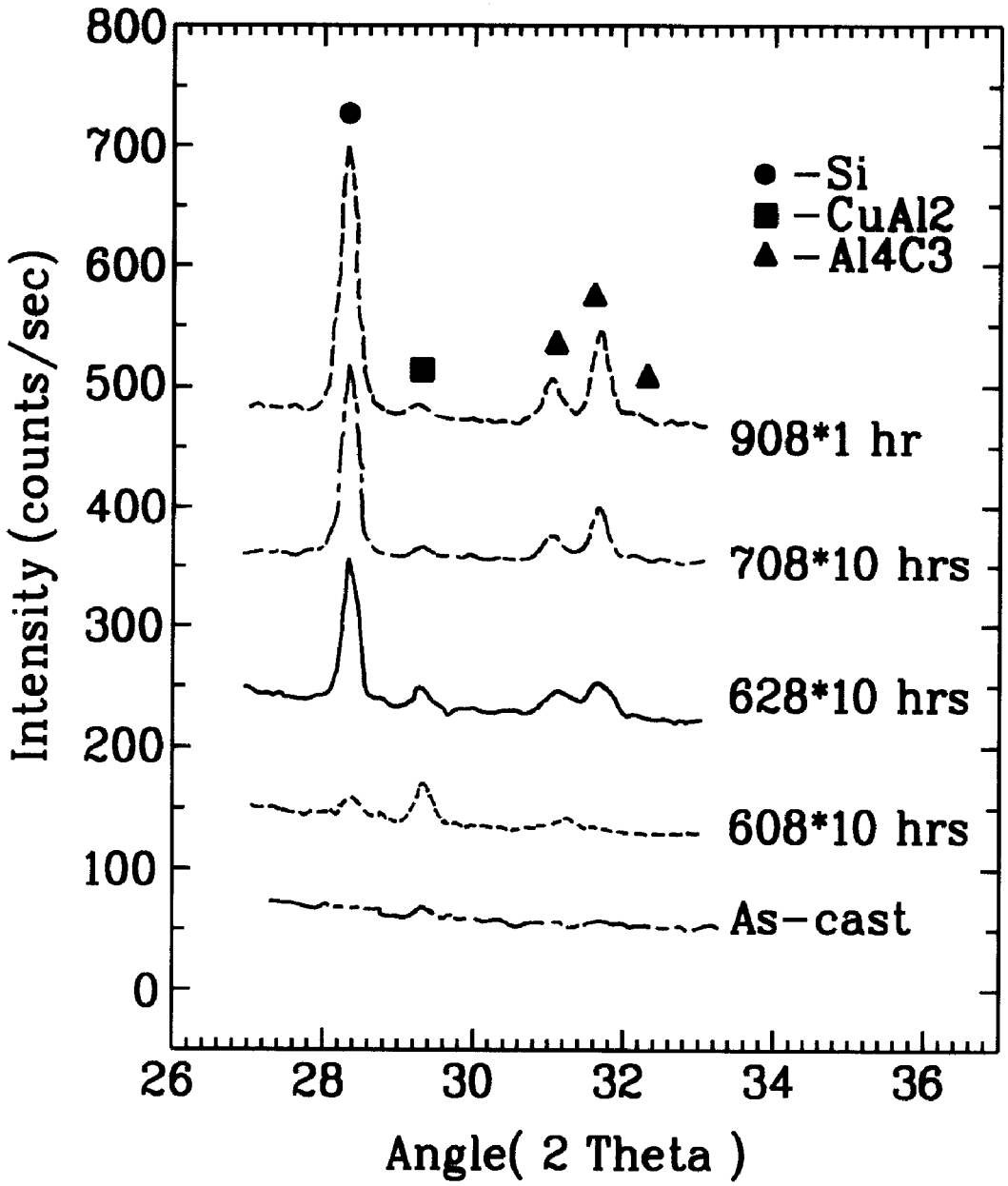
FIG. 6 is XRD spectra of the $SiC_p$/2014 Al composites showing the formation of $Al_4C_3$ and Si with increasing heat treating temperature and holding time.

XRD was employed to monitor the extent of the interfacial reaction in the $SiC_p$/Al composite. FIG. 6 is the XRD results obtained from composites, showing how the extent of the interfacial reaction vary with the heat treating temperature and holding time. As seen in the graphs, no evidence showing the presence of interfacial reaction products could be seen from the spray-formed composite. However, with a prolonged exposure at elevated temperatures, the formation of $Al_4C_3$ and Si within composites is evident from XRD. For example, when the composite was held at 609° C. for 10 hours, incipient peaks showing the formation of Si and $Al_4C_3$ were observed. With increased holding time and temperatures, intensities of diffraction peaks became stronger, indicating that the extent of the reaction were getting severe.

Although it may not be feasible to produce $SiC_p$/wrought Al alloy composites via the melt process, it was reported that various wrought Al alloy composites, devoid of interfacial reaction products, have been successfully made by the spray forming process. The main concern in this regard is how the spray-formed wrought Al alloy composites can be shaped into final products having relatively complex configurations. One of the possible processing techniques is the use of the semi-solid forming technique. The main advantage of this process against melt processes is the low process temperature required, i.e., the normal process temperature employed in this forming process is at least 150–200° C. lower than that used in most melt processes.

As can be seen from FIG. 4, two major process parameters for forming composites into the final configurations in the semi-solid state are the temperature and the Si content. These two parameters are to be selected in such a way that i) combinations of the process temperature and the Si content have to be located under the equilibrium Si content profile to avoid the interfacial reaction and ii) under such a condition, forming temperature and Si contents have to be selected to compromise required liquid fractions and resultant material properties of composites. In selecting the process temperature, it should be low as long as sufficient the liquid fraction required for forming is ensured. On the contrary, when selecting Si contents, the addition of Si has to be minimized to maintain the strength and ductility of the composite. However, it is not easy to fix one parameter without adjusting the other process parameter, since they are correlated with each other.

Figure 7:
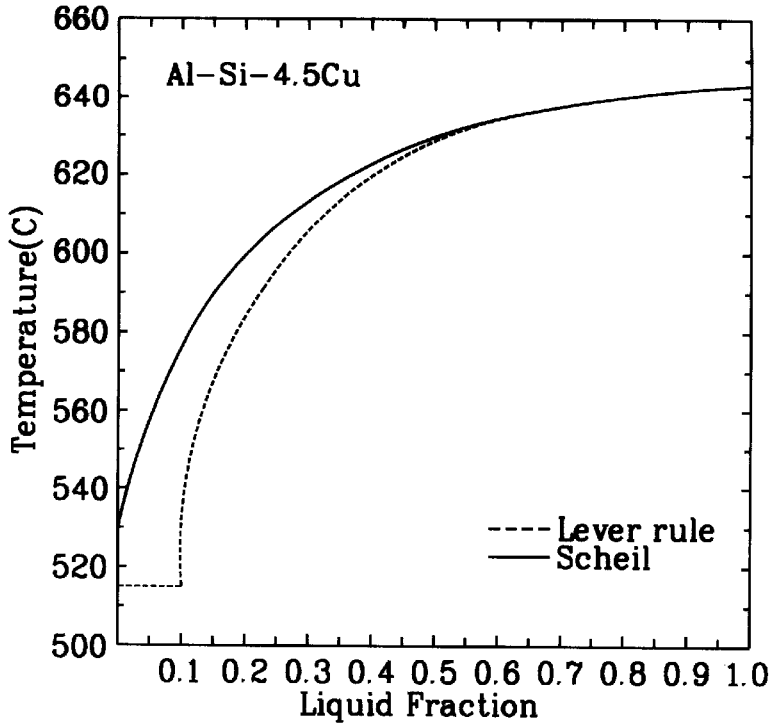
FIG. 7 shows liquid fraction calculated based on the lever rule and the Scheil equation.
Figure 8:
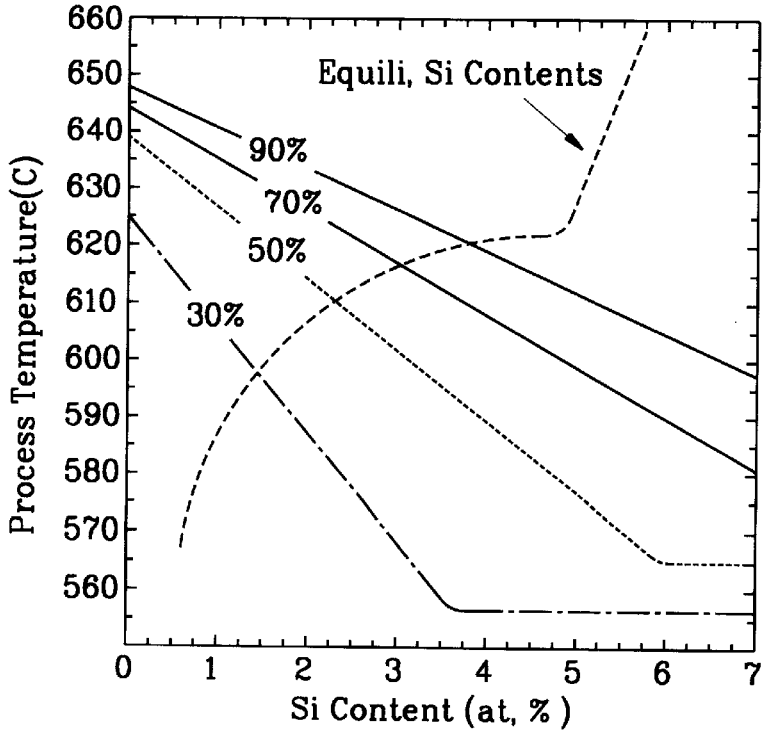
FIG. 8 shows suggested process parameters for the semi-solid forming. Numbers marked in graphs are the liquid fractions within the matrix. The area below the equilibrium Si content profile is that which satisfy the requirements for the semi-solid forming in terms of the liquid fraction and Si content.

Therefore, variations of the liquid fraction as a function of processing temperatures and Si contents were calculated in an attempt to suggest optimal processing criteria. Although the liquid fraction ($F_L$) can be calculated either using the lever rule or the Scheil equation given as Eq.(4), the Scheil equation is more popular for estimating the liquid fraction in the semi-solid state.

$$F_L=[(X_L)/(X_O)]^{1/(K-1)} \quad (4)$$

where $K=(X_L)/(X_O)$ and $X_O$, $X_L$ and $X_S$ are the Si content in the matrix alloy, liquid phase, and solid phase, respectively. An example showing the variation in the liquid fraction within the Al-0.94% Si-4.5% Cu (i.e., 2014 Al) is shown in FIG. 7. Identical methods were employed to calculate liquid fractions in the Al—Si-4.5%Cu alloys containing different Si contents, and the curves representing the equi-liquid fraction contours were plotted on the equilibrium Si content profile in FIG. 8. In this graph, the area below the equilibrium Si content profile satisfies the requirement for the semi-solid forming in terms of the liquid fraction and Si content.

When the matrix of the composite contains low Si, such as 2–4 at %, the liquid fraction within the matrix can reach as high as 70% at 610° C. Although such a liquid fraction may not be sufficient for thixocasting, it is considered to be possible to form the composite into the final configurations using the thixoforging process. With increasing Si contents within the matrix, the liquid fraction within the matrix increases even under the same temperature such that the matrix containing 5–7 at. % Si can possess 80–90% of the liquid phase even at 600° C. Such a feature suggests the possibility of the composite forming via the thixoforming process.

1. D. J. Lloyd, H. Legace, A. Mcleod, and P. L. Morris, Mater. Sci.Eng. A107,73(1989)
2. G. Gonzalez, L. Salvo, M. Surey, and G. L. Eserance, Script Metall. 33,1969 (1995)
3. "CRC Handbook of Chemistry and Physics": (74th edition, CRC press, 1992) p.4–36
4. "The MERCK INDEX": (10th edition, MERCK 7 CO., INC,1983)p.50.
5. J. C. Lee, J. Y. Byun, C. S. Oh, H. K. Seok, and Ho-In Lee, Acta Metall. mater., 45, 5303 (1997)
6. J. Naciso, C. Garcia-Cordovilla and E. Louis, Mater. Sci. Eng., B15, p.148(1992).
7. A. C. Ferro and B. Derby, Acta Metall. mater., vol. 43, No.5, p.3061 (1995).
8. J. C. Viala, P. Fortier and J. Bouix, J. Mater. Sci., vol.25, p.1842(1990).
9. H. Ribes, M. Suery, G. L'sperance, and T. G. Legoux, Mett. Trans. A., vol.21, p2489(1990).
10. W. M. Zhong, G. L'esperance, and M. Suery, Mett. Trans.A.vol.26, p.2637(1995).

11. A. S. Isaikin, V. M. Chubarov, B. F. Trefilov, V. A. Silaev, and Yu. A. Gorelov., Met. Sci. Heat Treatment vol.22, p.815 (1980)

12. T. Iseki, T. Kameda, and T. Maruyama, J. Mater. Sci., vol.19, p.1692(1984)

What is claimed is:

1. A thixoformable SiC/(2xxx Al+Si) composite comprising a product obtained by the steps of adding Si to an ASTM 2000 series aluminum alloy containing SiC to form a matrix, wherein the total Si content thereof is 1 to 5 at %; and spray forming a thixoformable SiC/(2xxx Al+Si) composite.

2. A method of manufacturing a SiC/(2xxx Al+Si) composite comprising spray forming a SiC reinforced composite from a matrix where additional Si is added to an ASTM 2000 series aluminum alloy containing SiC, such that the total Si content thereof is 1 to 5 at %;

maintaining said SiC reinforced composite at a temperature in the range of 560° C. to 610° C. wherein a liquid fraction of between 40% and 70% is obtained; and thixoforming said SiC reinforced composite.

* * * * *